United States Patent [19]

Schiferl

[11] Patent Number: 4,809,622

[45] Date of Patent: Mar. 7, 1989

[54] LOW DENSITY MATERIAL SLOT FURNACE WORKSTATION WALL

[75] Inventor: Joseph J. Schiferl, Johnson Creek, Wis.

[73] Assignee: General Signal Corporation, Stamford, Conn.

[21] Appl. No.: 135,505

[22] Filed: Dec. 18, 1987

Related U.S. Application Data

[63] Continuation of Ser. No. 30,776, Mar. 26, 1987, abandoned.

[51] Int. Cl.[4] ..... F23M 5/00

[52] U.S. Cl. ..... 110/336; 432/247; 432/250

[58] Field of Search ..... 432/247, 242, 250; 110/339, 331; 52/504

[56] References Cited

U.S. PATENT DOCUMENTS

| | | | |
|---|---|---|---|
| 3,429,562 | 2/1969 | Hewlett, Jr. | 432/250 |
| 3,832,815 | 9/1974 | Balaz et al. | 110/336 X |
| 4,246,852 | 1/1981 | Werych | 110/339 |
| 4,249,888 | 2/1981 | Werych | 432/3 |
| 4,300,882 | 11/1981 | Werych | 432/247 |
| 4,318,259 | 3/1982 | Verheyden | 110/336 X |
| 4,332,552 | 6/1982 | Seelandt | 432/209 |
| 4,576,574 | 3/1986 | Schantz | 432/250 X |

FOREIGN PATENT DOCUMENTS

| | | | |
|---|---|---|---|
| 0134511 | 3/1985 | European Pat. Off. | 432/247 |
| 2042699 | 9/1980 | United Kingdom | 432/247 |

*Primary Examiner*—Edward G. Favors

*Attorney, Agent, or Firm*—Joseph P. Abate; John F. Ohlandt

[57] ABSTRACT

An improved slot forge type furnace, including a front or workstation wall constituted of vacuum formed modules of fibrous insulating material; the wall in the form of an arch, is assembled of a number of elongated modules, sometimes referred to as logs, which are adhered together and compressively positioned abutting the interior side thermal lining and arched top of the furnace. As wear develops in the bottom edge of the front arch wall, which edge defines the top of the slot, the wall is removed, its bottom edge is cut back, and the wall is repositioned.

8 Claims, 1 Drawing Sheet

LOW DENSITY MATERIAL SLOT FURNACE WORKSTATION WALL

This is a continuation of application Ser. No. 030,776, filed Mar. 26, 1987, now abandoned.

The technical field of the invention is in furnaces employed in high temperature production operations wherein workpieces are heated in connection with fabrication steps to be performed on those workpieces.

BACKGROUND OF THE INVENTION

In the fabrication of workpieces wherein high temperature heating is employed to impart such properties to the workpiece as extrudability, malleability and even dimension variation, forge type furnaces are used into which workpieces are inserted for heating and then removed to a separate fabrication station for further processing. Where there are many workpiece insertions and removals it has been found advantageous to provide a relatively thin slot-shaped permanent opening in the wall of the furnace that is adjacent an insertion and removal workstation. The slot-shaped opening is in length close to the full length dimension of the heat area in the furnace. Such a permanent, precisely controlled, opening provides both workpiece insertion and removal efficiency and also a relatively uniform opening into the high temperature region of the furnace providing precision in temperature control.

The furnaces described above have come to be known in the art as slot forge furnaces. These furnaces are large, heavy installations positioned in the throughput chain of the workpiece processing operation such that repairs on an individual furnace may produce major disruptions in productivity. The interior walls of these furnaces are of thick temperature insulating material in block form and, depending on the installation size, the insulating walls are either supported by exterior metal walls or metal bracing. The front is usually considered to be the wall adjacent the workstation. It is shorter than the rear portion by the vertical dimensions of the slot. The front and the rear walls are desirably longer than the front to back dimension to provide more workpiece-processing accommodations. The top of the furnace is arched for strength purposes due to the long unsupported slot. The front or workstation wall is generally an insert positioned under and conforming to the top arch.

A significant refractory or insulating product, which came upon the scene about a decade or so ago, is made of fibrous material and is molded into a variety of shapes. Vacuum formation, sometimes called "vacuum molding", of such fibrous material is currently a well-known technique involving first, the forming of slurry of a material such as alumina-silica fibers in an inorganic solvent or binder. The slurry thus formed is then, in accordance with the technique, placed into a mold and, by means of a vacuum, liquid is drawn off, leaving only the fiber material in a semi-rigid molded shape sometimes called a module. In some cases of special shapes, the molded form is called a log. This insulating material has improved heat insulating properties, is lighter in weight than conventional materials previously employed, and can readily have holes placed in it after fabrication when useful in construction.

While the above described vacuum formed fibrous material has many advantageous properties, it has low resistance to abrasion. This disadvantage has generally precluded its use heretofore because of the damage sustained by the slot-shaped opening in the front wall of the furnace due to wear from the insertion and removal of the workpieces.

As an alternative, a poured front arch wall has been utilized, that is, a wall composed of high-temperature concrete which is shaped to include the requisite slotted opening. However, it has been found that such a fairly high temperature concrete wall is not capable of withstanding the thermal shocks involved when operating at extremely high temperatures in the range of 2,000 to 2,500 degrees F.

The present invention provides a unique solution to the problem of being able to operate at temperatures in the above-noted range; moreover, it enables overcoming the problem of spalling which occurs when a concrete wall that cannot sustain such temperatures is utilized; and of obtaining significant improvement in the lifetime of the front wall, such lifetime being five to ten times that of a concrete wall. The solution results from the recognition that, since the vacuum molded modules can be readily sawn or cut, one opts to fabricate the front wall of vacuum formed modules or logs of judiciously extended length. In other words, one makes an oversized wall. Accordingly, when the slotted opening defined by the wall becomes damaged by chipping or the like as the result of the workpieces constantly being pushed in through the slotted opening such that the opening becomes so enlarged that the proper interior temperature cannot be maintained, the wall is removed, the damaged part is cut away, and the wall is repositioned.

SUMMARY OF THE INVENTION

The invention resides in an improved slot forge type furnace in which the work station or front wall is constructed of oversize vacuum formed logs of fibrous insulating material. The term "oversize" in this context refers to the fact that the vertical dimension of the logs is longer than needed to cover the overall furnace opening. The fabrication of the front wall is such as to provide simplicity in construction, control over the slot dimension to insure proper temperature within the furnace, and to provide for an extended life of the front wall because of its inherent characteristic of being cut away quite easily so that the damaged bottom edge of the wall can be removed.

The simplified construction of the front wall involves a series of vacuum formed logs joined together in a side-by-side relationship, the smallest dimension of the logs lying in the foremost plane of the front wall. These logs are held together by a conventional adhesive applied to the abutting sides of the individual logs. When the furnace is to be operated, the front wall is positioned against the faces of the top arch of the furnace in the inside thermal walls, the front wall being retained by simple compression provided by a top and two side braces. As noted before, as constant wear due to the workpieces changes the size of the slot opening, the front wall of the invention is readily disassembled and the portion distorted by wear removed, typically by a sawing operation. This operation may be repeated as often as wall stock remains to cover the highest portion of the arched furnace top. As a result of being able to perform this operation, the life of the front wall is extended five to ten times over the conventional poured concrete wall.

An ancillary feature of the present invention resides in the provision of having the fiber grains of the individual logs that constitute the wall oriented appropriately so as to achieve the highest temperature rating possible for the furnace. In the formation of the individual logs in the vacuum molding process, the nature of the process is such that the particular orientation for the fiber grains is determined by the screen employed in the mold and this corresponds with the transverse dimension of the logs, that is the dimension which is in the direction of the front to rear dimension of the furnace. Accordingly, it is a further advantage of the invention that one increases the temperature range at which the furnace can be operated in a very inexpensive manner due to the fiber grain orientation just indicated. The reason for this is that, with the fiber grains running this way, there is greatly reduced shrinkage of the fibers caused by the furnace heat. The only other alternative to achieve the higher temperature rating is to include much more expensive material in the constitution or make up of the individual logs. Therefore, it will be apparent that this ancillary feature is an important part of the present invention.

Other and further objects, advantages and features of the present invention will be understood by reference to the following specification in conjunction with the annexed drawing, whrein like parts have been given like numbers.

DESCRIPTION OF INVENTION

Figure 1:
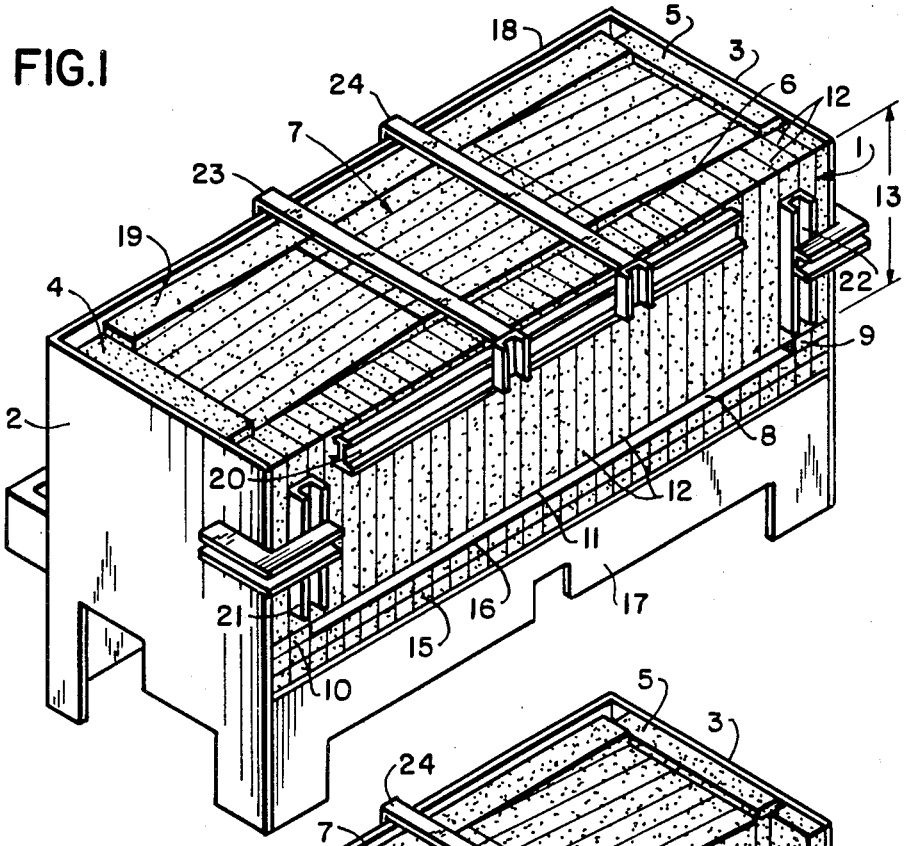
FIG. 1 is a schematic view of the assembled slot forge furnace.

In accordance with the invention the slot forge furnace is shown assembled in FIG. 1 with the front or workstation wall 1 mounted in position between the two sides 2 and 3, the wall abutting the faces of the insulative lining material elements 4 and 5 for each side and abutting the face 6 of the arched top 7. The front wall 1 is positioned, in the vertical dimension, a distance from the lower face 8 of the slot by spacer member 9 and 10 with the front edge 11 of the wall 1 serving as the top face of the slot. The wall 1 is assembled of vacuum formed fibrous material logs 12 having a length dimension 13 substantially longer than the distance from the upper slot face 11 to the highest point 14 of the arch top 7. In practice, the over-size dimension 13 permits several operations of removing damaged material from the upper slot face 11, as well as an initial operation prior to cutting any of the front wall, of reversing the top and bottom of the front wall. The material 15 forming a workshelf and lining the lower slot face 16 is of refractive abrasion-resistant heat insulating material such as brick and is supported by the front frame 17.

The construction of the back is similar to the sides, having a supporting frame member 18 and thermal lining 19. The wall 1 is retained in abutting relationship with the top 7 and side linings 4 and 5 by a top compression support member 20 and two sides compression support members 21 and 22. The support member 20 is held in compressing position by members 23 and 24 that are sufficient in number for even compression. While the members 23 and 24 are illustrated as being straight and merely providing a clamping function with respect to the back frame 18 it will be apparent to one skilled in the art that members 23 and 24 can be provided with an arcuate shape to provide additional clearance to permit extension of dimension 13.

Figure 2:
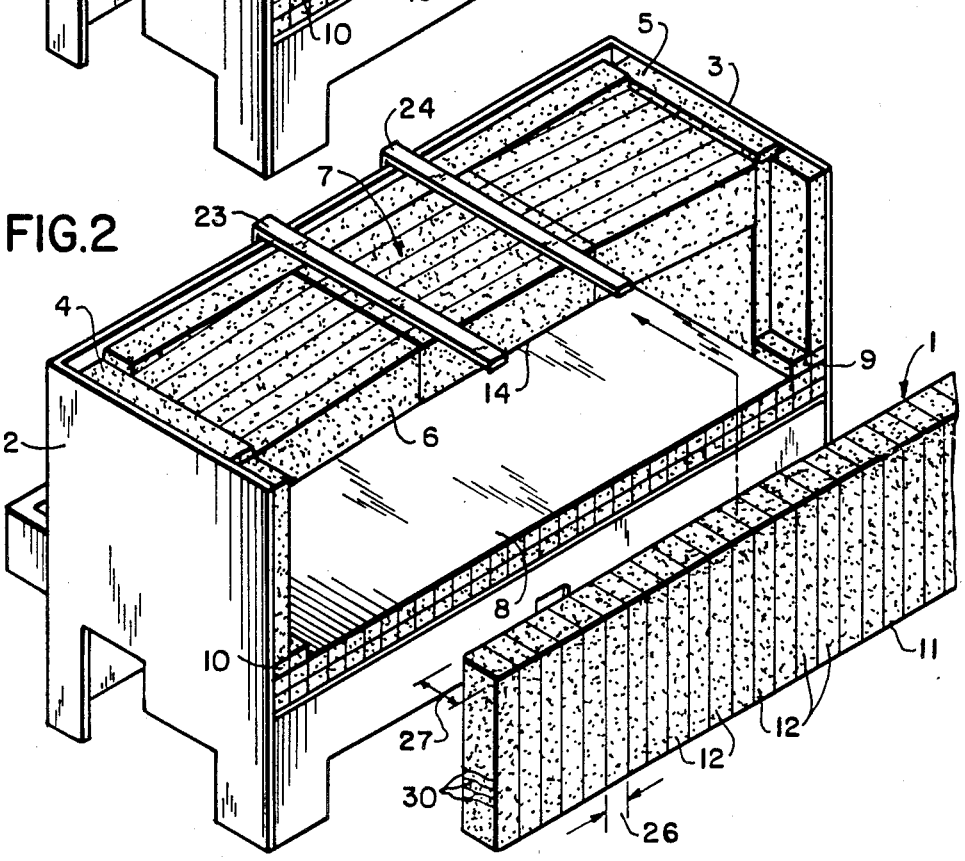
FIG. 2 is an exploded schematic view of the slot forge furnace showing the interior of the furnace the front wall being separated from the rest of the furnace.

Referring next to FIG. 2, an exploded schematic view is provided to illustrate the wall construction features. In FIG. 2, where the same reference numerals are used for like elements or materials, the support members 20, 21 and 22 are not shown. The individual vacuum formed fibrous material logs 12 of the wall 1 are retained as a unit because of adhesion of the abutting faces 27 of logs 12. This is realized by use of an adhesive such as carborundum QF-180 cement.

BEST MODE OF CARRYING OUT THE INVENTION

The wall 1 would be constructed of the vacuum-formed fibrous insulating material, known in the art under the trade name Moldatherm, and constituted, in one example, of low-shrink fiber (approximately 49.2% $Al_2O_3$ and 50.5% $S_1O_2$). The material would be fabricated in the form of logs 12 having dimensions 26 and 27 of 4 inches wide×10 inches thick, respectively, and having a height dimension 13 of 36 inches. The furnace would operate at temperatures in the range of 2000°-2500° F.

By having the fiber grains 30 of logs 12 oriented so as to extend lengthwise along the front to rear furnace dimension, a temperature of approximately 2200° F. is readily attainable. As the edge 11 becomes damaged due to grooves caused by rod-shaped workpieces abrading it, the temperature in the furnace is caused to vary beyond an acceptable tolerance. However, the edge 11 is easily restored by means of a saw cut, due to the characteristic of the fibrous material, to the depth of the grooves while the wall 1 is in the disassembled position of FIG. 2. The wall is then repositioned so that the proper vertical dimension for the slot is reestablished.

What has been disclosed is a slot forge type furnace having a front wall formed of logs of vacuum formed fibrous material, preferably alumina-silica, employed to extend life, minimize downtime and simplify construction. Additionally, due to the fact that the fiber grains are oriented, as previously noted, in the transverse direction, i.e. in the direction corresponding with the front to rear dimension of the furnace, shrinkage of the fibers is minimized. Consequently, a higher temperature rating than would be possible otherwise is achieved. An increased rating of 200° F. above what could otherwise be realized with conventional or random orientations is attained.

While there has been shown and described what is considered at present to be the preferred embodiment of the present invention, it will be appreciated by those skilled in the art that modifications of such embodiment may be made. It is therefore desired that the invention not be limited to this embodiment, and it is intended to cover in the appended claims all such modifications as fall within the true spirit and scope of the invention.

What is claimed is:

1. A workpiece furnace of the type having an interior heating area surrounded by thermally insulated walls and an arched top, and having a slotted opening which is defined by a front wall of the furnace, for workpiece insertion and removal, comprising in combination:

a front wall having a vertical dimension extending from the upper dimension of said slot to substantially beyond the upper most point in the arched top, said front wall being formed of elongated, vacuum-formed insulating fiber logs in side-by side relationship, first means for retaining said front wall against the arched top of said apparatus and second means for retaining said front wall against the sides of said apparatus.

2. Apparatus as defined in claim 1, in which the insulating fiber is alumina-silica.

3. Apparatus as defined in claim 1, in which the insulating fibers of the logs are oriented in a direction corresponding with the front-to-rear dimension of said wall.

4. The apparatus of claim 2 wherein said first retaining means is a bracing member having a longitudinal bar in contact with each said individual vacuum-formed insulating material member, said bracing member being retained in position in at least one location by a member secured to the frame supporting the top and other walls of said apparatus.

5. A slot forge furnace, comprising:

a furnace having three closed, insulatively lined sides, and one open side;

a front wall adapted to be positioned at said open side, and an arched insulatively lined top;

a work-level ceramic shelf on said open side;

first and second spacer elements positioned at each end of said shelf for establishing the dimensions of a slotted opening adapted to receive workpieces;

said front wall abutting the spaced faces of the two separated, insulatively lined sides and abutting said top insulative lining, the vertical dimension of the front wall being at least as great as the vertical distance from said spacer elements to the highest point in the arch of said top;

and compression means for urging said front wall into contact with said sides and said top.

6. The furnace of claim 5 wherein said compression means includes support and retention members evenly supplying force toward said faces.

7. The furnace of claim 6 wherein said front wall is made up of a plurality of vacuum-formed insulating logs having the length dimension thereof serving as the vertical dimension of said wall.

8. The furnace of claim 7 wherein said plurality of logs is retained as a unitary structure by adhesion of said logs.

* * * * *